United States Patent [19]

Arentsen et al.

[11] Patent Number: 4,517,709

[45] Date of Patent: May 21, 1985

[54] CLOTHES HANGER HOOK

[75] Inventors: Norbert Arentsen, O'Fallon; Frances A. Rentchler, P.O. Box 15, Belleville, Ill. 62222

[73] Assignee: Frances Rentchler, Belleville, Ill.

[21] Appl. No.: 630,308

[22] Filed: Jul. 12, 1984

Related U.S. Application Data

[63] Continuation of Ser. No. 428,887, Sep. 30, 1982, abandoned.

[51] Int. Cl.[3] ..... A47J 51/095

[52] U.S. Cl. ..... 24/232 R; 24/233; 24/241 P; 223/85; 223/DIG. 4

[58] Field of Search ..... 223/85, DIG. 4; 24/234, 24/235, 241 P, 242, 233, 232 R; 248/339, 340

[56] References Cited

U.S. PATENT DOCUMENTS

| | | | |
|---|---|---|---|
| 85,646 | 1/1869 | Dolan | 24/242 |
| 123,236 | 1/1872 | Cathcart | 24/242 |
| 171,361 | 12/1875 | Dudley | 24/234 |
| 297,498 | 4/1884 | Carpenter | 24/241 P |
| 358,565 | 3/1887 | Osborne | 24/234 X |
| 377,559 | 2/1888 | Hitchcock | 24/242 |
| 429,362 | 6/1890 | Nelson | 24/234 |
| 2,671,938 | 3/1954 | Roberts | 223/85 X |

FOREIGN PATENT DOCUMENTS

| | | | |
|---|---|---|---|
| 29461 | 4/1931 | Australia | 24/242 |
| 92465 | 12/1961 | Denmark | 24/242 |

*Primary Examiner*—Robert R. Mackey

*Attorney, Agent, or Firm*—Polster, Polster and Lucchesi

[57] ABSTRACT

A clothes hanger hook has a fixed part with a shank and a crook with a free end and a movable part hinged to the crook. The movable part has a nose, wings extending from the nose and straddling at least a part of the crook and a bottom wall bridging and connecting the wings below an adjacent surface of the crook. A spring seat extends into the nose part, and a spring with one end mounted on the seat and another on the crook biases the nose section of the movable part toward the shank and the bottom wall of the movable part into engagement with an inner surface of the crook.

8 Claims, 14 Drawing Figures

CLOTHES HANGER HOOK

This is a continuation, of application Ser. No. 428,887, filed Sept. 30, 1982 now abandoned.

BACKGROUND OF THE INVENTION

Clothes hanger hooks with keepers are well known. A particularly elegant prior art device is illustrated and described in Rentchler U.S. Pat. No. 2,164,941. Other examples are disclosed in U.S. Pat. Nos. to Wolf, 3,136,019 and Palmaer, U.S. Pat. No. 4,155,493. The Renchler and Wolf keepers are gravity biased to an open position. The Palmaer hanger requires a long handle section, and does not utilize the weight of the clothes to clamp the keeper about a supporting rod. None of the prior art devices lends itself to graceful decoration.

One of the objects of this invention is to provide a clothes hanger in which a keeper is normally biased toward a closed position, and is further biased toward that position by a load placed on it.

Another object is to provide a simple, graceful clothes hanger hook which lends itself to decoration.

Other objects will become apparent to those skilled in the art in the light of the following description and accompanying drawings.

SUMMARY OF THE INVENTION

In accordance with this invention, generally stated, a clothes hanger hook is provided with a fixed part having a shank and a crook with a free end and spring mounting means at the free end, and a movable keeper part hinged to the crook, the keeper having a nose, wings extending from the nose and adapted to straddle at least a part of the crook and a bottom wall bridging between and connecting the wings below an adjacent surface of the crook. A seat extends into the nose part on which one end of a spring is mounted, the other end of the spring being mounted on the spring mounting means on the crook. Means are provided for hinging the keeper to the crook at a point close to the free end, the pivot point being outboard, with respect to the shank, of the area of the keeper that bears the weight of the clothes when the hook is hanging on a rod. The spring biases the nose part of the keeper toward the shank, and the bottom wall of the keeper into engagement with an inner surface of the crook. In the preferred embodiment, the keeper is cast in one piece, and at least one side wall of the keeper is embossed with a design.

DESCRIPTION OF THE PREFERRED EMBODIMENT

Figure 1:
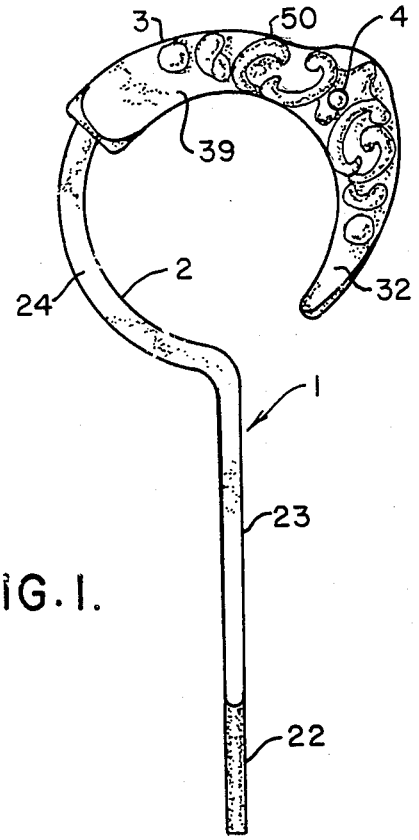
FIG. 1 is a view in front elevation of one embodiment of hanger hook of this invention.

Referring now to the drawings, for one illustrative embodiment of this invention, reference numeral 1 indicates an assembled hanger hook which, in this embodiment, consists of a fixed part 2 and a movable keeper 3, hingedly mounted on the fixed part by means of a hinge pin 4.

The fixed part 2 has a round tang 22 adapted to extend through a hole in a hanger, not here shown, and to be headed over to hold it into position. Above the tang 22, in this embodiment, the hook has a shank 23, rectangular in cross-section and a crook 24, also rectangular in section. The crook 24 has an enlargement 25 at its free end. The enlargement 25 has an outer flat surface 26 from which a projection 27 extends. A bearing pin hole 28 extends transversely through the enlargement, close to but inboard of the juncture of the flat surface 26 and an inner surface 29 of the crook 24.

The movable keeper 3 of this embodiment has a closed nose section 32 and two wings 33 and 34, spaced from one another and connected to one another along their lower edges by a bottom wall 35. Above the bottom wall 35, the wings straddle the crook 24. Transversely aligned holes 38 in the two wings 33 and 34 are aligned with the hole 28, and the pin 4 extends through all three holes and is headed at its two ends, thereby hinging the keeper to the fixed part crook. The nose section 32 has formed in it a spring seat 36. A spring 37 is seated at one end in the bottom of the seat 36, and at its other end on the projection 27 of the crook 24.

In the embodiment shown, a side surface 39 of the wing 33 is provided with a decorative embossment 50, while the corresponding side of the wing 34 is left plain.

Figure 2:
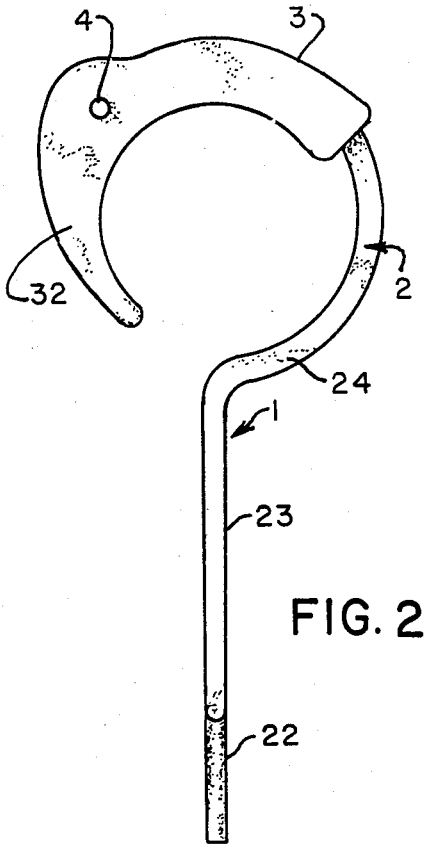
FIG. 2 is a view in rear elevation of the hook shown in FIG. 1.
Figure 3:
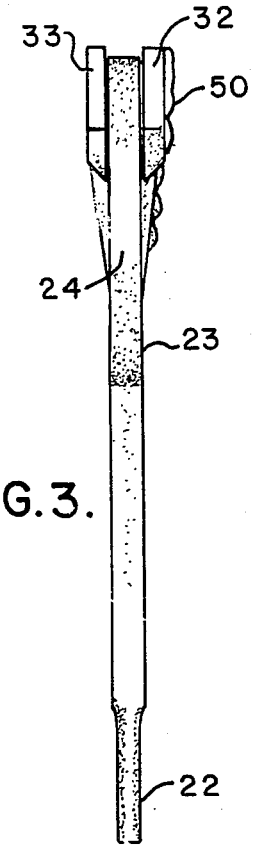
FIG. 3 is a view in side elevation in the direction from left to right of the hook as viewed in FIG. 1.
Figure 4:
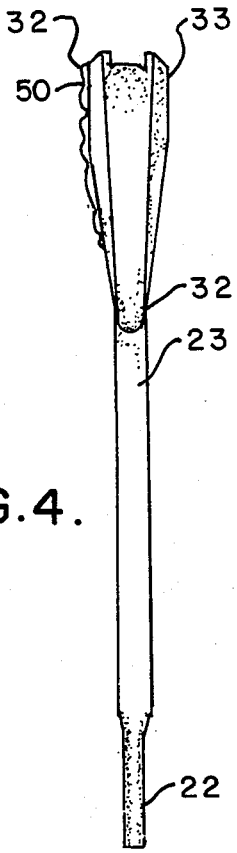
FIG. 4 is a view in side elevation in the direction from right to left as viewed in FIG. 1.
Figure 5:
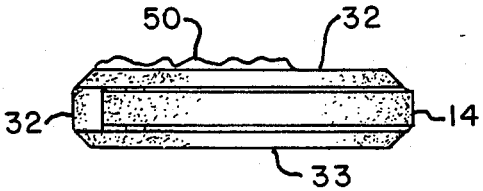
FIG. 5 is a top plan view.
Figure 6:
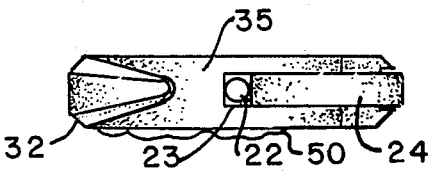
FIG. 6 is a bottom plan view.
Figure 7:
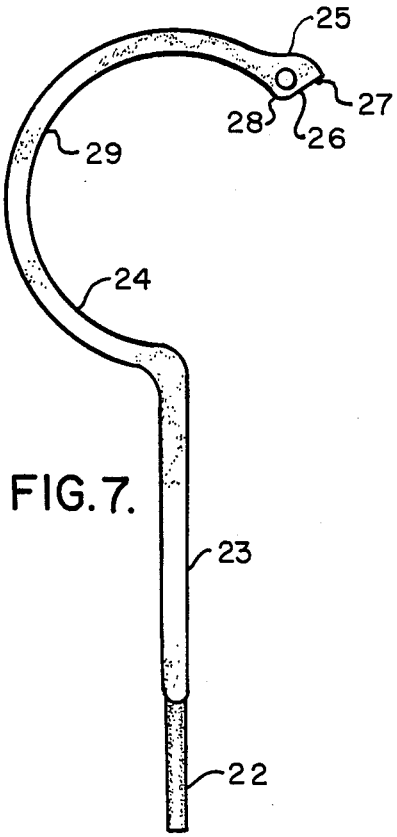
FIG. 7 is a view in front elevation of a fixed part of the hook.
Figure 8:
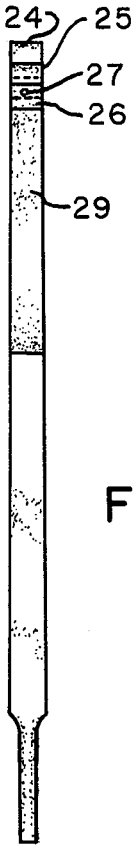
FIG. 8 is a view in side elevation in the direction from right to left of the fixed part as shown in FIG. 7.
Figure 14:
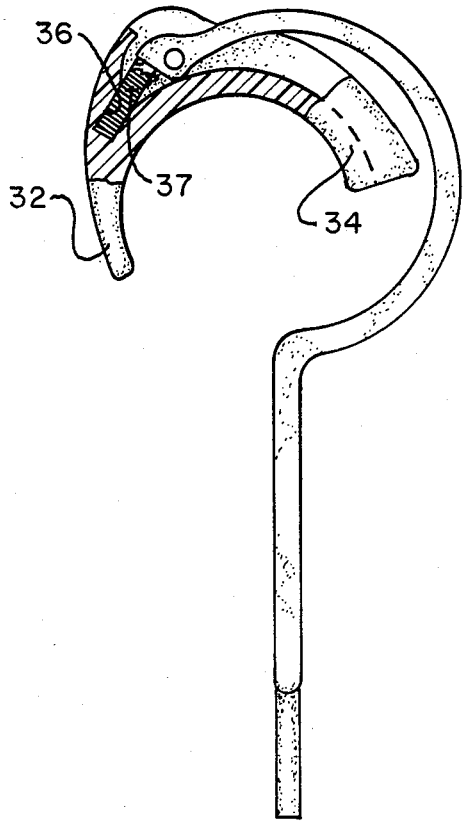
FIG. 14 is a view in rear elevation of the assembled hanger hook with the keeper opened against the bias of the spring.
Figure 9:
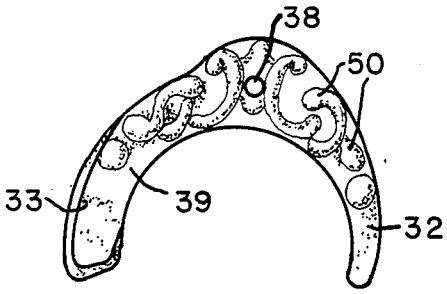
FIG. 9 is a view in front elevation of the movable keeper of the hook shown in FIG. 1.
Figure 10:
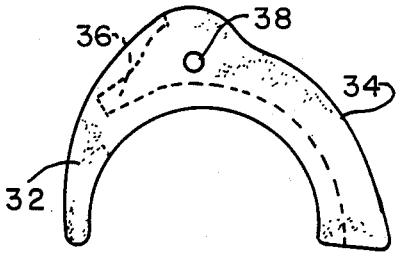
FIG. 10 is a view in rear elevation of the movable keeper, with an internal cavity shown in dotted line.
Figure 13:
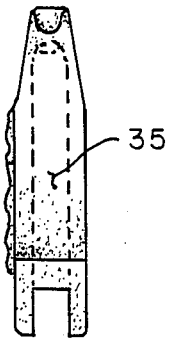
FIG. 13 is a bottom plan view of the keeper.
Figure 11:
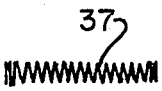
FIG. 11 is a view in side elevation of a helical compression spring.
Figure 12:
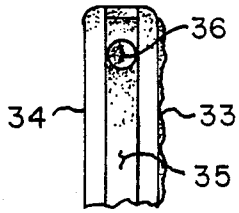
FIG. 12 is a fragmentary view in side elevation, viewed from right to left of FIG. 10.

The spring 37 is a compression spring, and as can be seen more particularly in FIG. 14, where the keeper has been swung to an open position against the bias of the spring, the spring exerts a constant, though moderate, bias toward the position shown in FIGS. 1 and 2, at which the nose is relatively close to the shank 23, and the bottom wall 35 engages at least a portion of the surface 29 of the crook 24. It can be seen, particularly by reference to FIG. 2, that the hinge axis of the keeper 3 lies outboard of a hanger rod on which the hook rests, so that when the hanger hook is mounted on a hanger rod, the weight of the hanger and its load increases the bias of the keeper toward the closed position at which the nose 32 is closest to the shank 23.

In assembling the hanger hook of this invention, the spring 37 is seated in the seat 36, the crook enlargement 25 is put into a position at which the projection 27 is encircled by the other end of the spring and the hole 28 is aligned with the holes 38, and the pin 4 is slipped through the holes, and its ends peened. If one end of the pin is already headed, only one end need be peened The pin can be soldered or otherwise secured, instead of being headed. The assembled hook can then be mounted on any kind of hanger in which a hole is provided to accept the tang 22.

Numerous variations in the construction of the hanger hook of this invention, within the scope of the appended claims, will become apparent to those skilled in the art in the light of the foregoing disclosure. Merely by way of illustration, the external configuration of the keeper, which in the present illustrative embodiment, has a small hump in the upper surface of the wings adjacent the seat part of the nose section, can be modified. In the preferred embodiment, the keeper is cast of copper, bronze or brass, or other nonferrous metal, in one piece. One or both of the parts may be made of plastic. They can also be made of sheet metal. The side surfaces of both wings can be embossed or otherwise decorated, or both can be left plain. The keeper or the fixed part or both can be plated or metalized, or, if they are made of aluminum or other suitable material, anodized. The projection 27 can be given different configurations, or may be replaced by a shallow socket to form a seat for the end of the spring. The seats can take the form of tabs on the side of the crook and nose cavity, or recesses to accommodate springs of different types, so long as the spring biases the two seats away from one another, although the helical spring of the preferred embodiment has advantages of simplicity, economy and reliability. Similarly, particularly if the keeper is made of sheet metal, a projection or other mounting means can be provided in the nose section on which the outer end of the spring can be seated. Although the rectangular cross-section of the shank and crook of the fixed part are preferred, they can be made either round or polygonal or otherwise configured in cross-section. If the wings are made capable of being sprung outwardly and to spring back, the hinge pin can be made integral with the crook, in the form of studs to snap into holes or sockets in the wings. The pin itself can either be journaled in the hole in the crook or in the holes in the wings, or both, to permit free movement of the keeper around the pin axis. The configuration of the tang forms no part of this invention, and it can be of any shape, length, or character. These are merely illustrative.

We claim:

1. A clothes hanger hook comprising a fixed part having a shank with a round tang as an extension of one end thereof and adapted to extend through a hole in a hanger, and a crook with a free end and spring mounting means on said free end at the other end of said shank, and a movable keeper hinged to said crook, said movable keeper having a nose part with an outer end normally extending in a substantially continuous arc with said crook beyond said free end, wings extending from said nose part and straddling at least a part of said crook and a bottom wall bridging between and connecting said wings below an adjacent surface of said crook, a seat in said nose part, a spring with one end mounted on said seat and another end on said crook end spring mounting means, and means behind the crook end spring mounting means for hinging said movable keeper to said crook, said spring biasing the nose part of said movable keeper in a direction toward said shank but spaced therefrom and the bottom wall of said movable keeper into engagement with only a portion of an inner surface of said crook to limit the travel of said keeper nose toward said shank, the hinge axis of said hinging means being inboard of a hanger rod on which the hook rests, whereby the weight of the hanger and its load increases the bias of the keeper toward the closed position.

2. The hook of claim 1 wherein a side surface of at least one of said wings is decorated.

3. The hook of claim 2 wherein one of said wings is decorated, the other, plain.

4. The hook of claim 1 wherein the spring is a helical compression spring and the crook spring mounting means is a projection.

5. The hook of claim 1 wherein said bridging bottom wall is continuous from the nose part to a free end of said wings.

6. The hook of claim 1 wherein said shank and crook are rectangular in cross-section.

7. The hook of claim 1 wherein transversely aligned holes are provided through said wings and a transverse hole through said crook, and a pivot pin extends through said holes and is headed at both ends to provide the hinge means.

8. The hook of claim 1 wherein the movable keeper is cast in one piece.

* * * * *